US010294662B1

(12) United States Patent
Conklin

(10) Patent No.: US 10,294,662 B1
(45) Date of Patent: May 21, 2019

(54) GLASS DECKING MOUNTING SYSTEM

(71) Applicant: Wayne Conklin, Butler, NJ (US)

(72) Inventor: Wayne Conklin, Butler, NJ (US)

( * ) Notice: Subject to any disclaimer, the term of this patent is extended or adjusted under 35 U.S.C. 154(b) by 19 days.

(21) Appl. No.: 15/864,849

(22) Filed: Jan. 8, 2018

(51) Int. Cl.

| | |
|---|---|
| ***E04B 5/02*** | (2006.01) |
| ***E04B 5/46*** | (2006.01) |
| ***E04D 13/03*** | (2006.01) |
| ***E04D 3/36*** | (2006.01) |
| ***E04D 1/36*** | (2006.01) |
| *E04D 1/34* | (2006.01) |

(52) U.S. Cl.
CPC ..... *E04B 5/023* (2013.01); *E04B 5/46* (2013.01); *E04D 1/36* (2013.01); *E04D 3/36* (2013.01); *E04D 13/03* (2013.01); *E04B 2103/00* (2013.01); *E04D 2001/3494* (2013.01)

(58) Field of Classification Search
CPC .... E04D 1/36; E04D 3/36; E04D 3/38; E04D 3/3605; E04D 13/03; E04D 13/0315; E04D 13/0325; E04D 13/032; E04D 13/12; E04D 2001/3494; E04B 5/023; E04B 5/46; E04B 2103/00; E04F 15/08
USPC ..... 52/306, 308, 483.1, 200, 263
See application file for complete search history.

(56) References Cited

U.S. PATENT DOCUMENTS

| | | | | |
|---|---|---|---|---|
| 2,193,393 | A | 3/1940 | Danner | |
| 2,618,819 | A | 11/1952 | Goodwillie | |
| 4,074,480 | A | 2/1978 | Burton | |
| 4,212,291 | A * | 7/1980 | Erb | F24S 10/73 126/669 |
| 4,222,213 | A | 9/1980 | Kessler | |
| 4,294,649 | A | 10/1981 | Sarka | |
| 4,431,691 | A | 2/1984 | Greenlee | |
| 4,479,988 | A | 10/1984 | Dawson | |
| 4,520,602 | A | 6/1985 | Miller | |
| 4,994,309 | A | 2/1991 | Reichert et al. | |
| 4,999,964 | A | 3/1991 | Taylor | |
| 5,003,744 | A | 4/1991 | Taylor | |
| 5,042,210 | A | 8/1991 | Taylor | |
| 5,087,489 | A | 2/1992 | Lingemann | |
| 5,088,258 | A | 2/1992 | Schield et al. | |
| 5,207,036 | A | 5/1993 | Sampson et al. | |

(Continued)

FOREIGN PATENT DOCUMENTS

| | | |
|---|---|---|
| AU | B4022989 | 3/1990 |
| AU | B5464990 | 11/1990 |

(Continued)

*Primary Examiner* — Joshua J Michener
*Assistant Examiner* — Matthew J Gitlin
(74) *Attorney, Agent, or Firm* — Goldstein Law Office, P.C.

(57) ABSTRACT

A glass decking assembly for securing a pair of adjacent glass panels, each having an outer edge and an inner edge, to a building structure, using a pair of outer framing members and an intermediate framing member that secures to the building structure with fasteners. A pair of outer setting blocks and an inner setting block covers the fasteners, attaches to the outer framing members and the inner framing member, and supports the adjacent glass panels with the outer edges supported by the outer setting blocks on the outer framing members and the inner edges supported by the intermediate setting block on the intermediate framing member. A lighting channel in the outer framing member facilitates edge lighting the glass panels.

8 Claims, 9 Drawing Sheets

(56) References Cited

U.S. PATENT DOCUMENTS

| | | | | |
|---|---|---|---|---|
| 5,218,806 | A | 6/1993 | Taylor | |
| 5,424,111 | A | 6/1995 | Farbstein | |
| 5,913,785 | A * | 6/1999 | Møller | E04D 13/0305 49/DIG. 1 |
| 6,055,783 | A * | 5/2000 | Guhl | C03C 27/06 156/109 |
| 8,225,561 | B2 | 7/2012 | Voegele, Jr. et al. | |
| 8,291,674 | B2 | 10/2012 | Valentz et al. | |
| 8,381,490 | B2 | 2/2013 | Back et al. | |
| 8,397,468 | B2 | 3/2013 | McClure | |
| 8,701,362 | B2 | 4/2014 | Stone | |
| 9,359,776 | B2 * | 6/2016 | Beltran Albarran | H01L 31/048 |
| 9,441,378 | B1 * | 9/2016 | Conklin | E04D 13/0315 |
| 9,920,532 | B1 * | 3/2018 | Conklin | E06B 3/6617 |
| 9,926,709 | B1 * | 3/2018 | O'Keeffe | E04B 5/46 |
| 2004/0123550 | A1 * | 7/2004 | Hartman | E04B 7/024 52/831 |
| 2006/0042680 | A1 * | 3/2006 | Korman | E04D 3/38 136/251 |
| 2006/0272232 | A1 | 12/2006 | Fooks | |
| 2009/0110866 | A1 | 4/2009 | Ainz et al. | |
| 2014/0109499 | A1 | 4/2014 | Nieminen et al. | |

FOREIGN PATENT DOCUMENTS

| | | |
|---|---|---|
| CA | 2015714 | 11/1990 |
| CA | 1328970 | 5/1994 |
| EP | 0356374 | 2/1990 |
| EP | 0396075 | 11/1990 |
| GR | 3017183 | 11/1995 |
| IE | 62450 | 2/1995 |
| IE | 67796 | 5/1996 |
| MX | 165468 | 11/1992 |
| MX | 172717 | 1/1994 |
| NZ | 230417 | 3/1993 |
| WO | WO2004042164 | 5/2004 |
| WO | WO2005019561 | 3/2005 |
| WO | WO2007011561 | 1/2007 |
| WO | WO2009056186 | 5/2009 |
| WO | WO2012041325 | 4/2012 |
| WO | WO2014066385 | 5/2014 |

* cited by examiner

GLASS DECKING MOUNTING SYSTEM

TECHNICAL FIELD

The present disclosure relates generally to glass decking. More particularly, the present disclosure relates to a system for integrating multi-panel glass assemblies with conventional building structures.

BACKGROUND

Structural glass panels being used as a walkable surface is a relatively new and unexplored application. The nature of glass as a building material presents new challenges to architects and structural engineers, and thus requires the development of new systems and concepts to overcome these challenges.

Among the challenges of using structural glass is the difficulty of fastening panels. Many conventional fastening systems cannot be used with structural glass. In addition, one of the sought after features of glass as a building material is its transparency and seamless appearance. Most conventional fasteners will either spoil this seamless appearance or reveal their unsightly nature since the nature of the glass would be to reveal that which is ordinarily concealed by opaque building materials.

Various fastening systems have been proposed and are available for securing a variety of building materials. While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a system that facilitates the use of structural glass in providing a walkable surface in conjunction with a building structure. Accordingly, the present disclosure provides a glass decking mounting system that effectively supports structural glass on a conventional building structure using outer framing members.

It is another aspect of an example embodiment in the present disclosure to allow large walkable surfaces to be created with multiple panels of structural glass. Accordingly, the mounting system includes intermediate framing members that provide an effective solution for mid-span support of adjacent glass panels.

It is yet another aspect of an example embodiment in the present disclosure to conceal fasteners that secure the framing members to the building structure to prevent them from interfering with the aesthetic of the glass. Accordingly, the fasteners are effectively hidden beneath the glass setting blocks that extend between the framing members and the glass panels.

It is a further aspect of an example embodiment in the present disclosure to provide an easy, effective, and inexpensive solution for edge lighting the glass panels. Accordingly, the framing members have a lighting channel that may be used to juxtapose a lighting strip immediately adjacent to the glass panels.

Accordingly, the present disclosure describes a glass decking assembly for securing a pair of adjacent glass panels, each having an outer edge and an inner edge, to a building structure, using a pair of outer framing members and an intermediate framing member that secure to the building structure with fasteners. A pair of outer setting blocks and an inner setting block covers the fasteners, attaches to the outer framing members and the inner framing member, and supports the adjacent glass panels with the outer edges supported by the outer setting blocks on the outer framing members and the inner edges supported by the intermediate setting block on the intermediate framing member. A lighting channel in the outer framing member facilitates edge lighting the glass panels.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 3A:
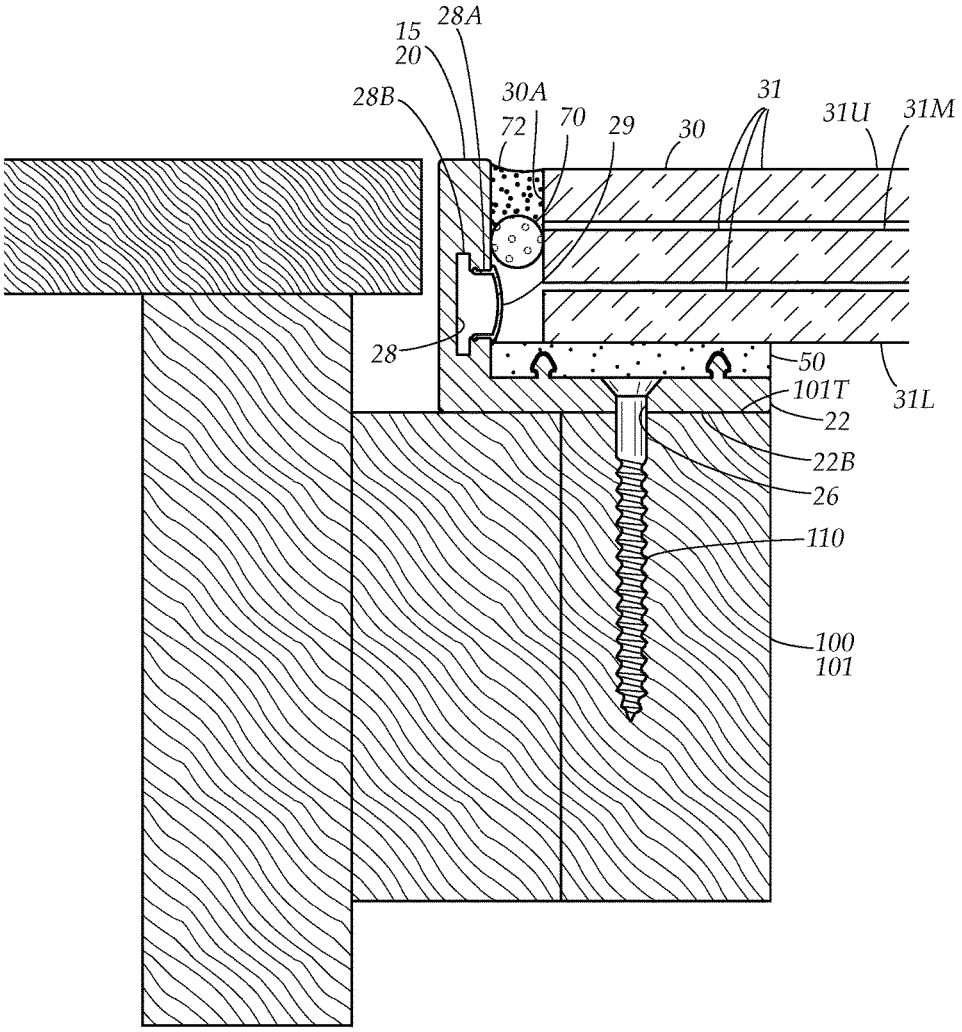
FIG. 3A is a side elevational view with parts broken away, illustrating a glass decking assembly where the outer framing member is fastened to wooden structural elements.
Figure 4A:
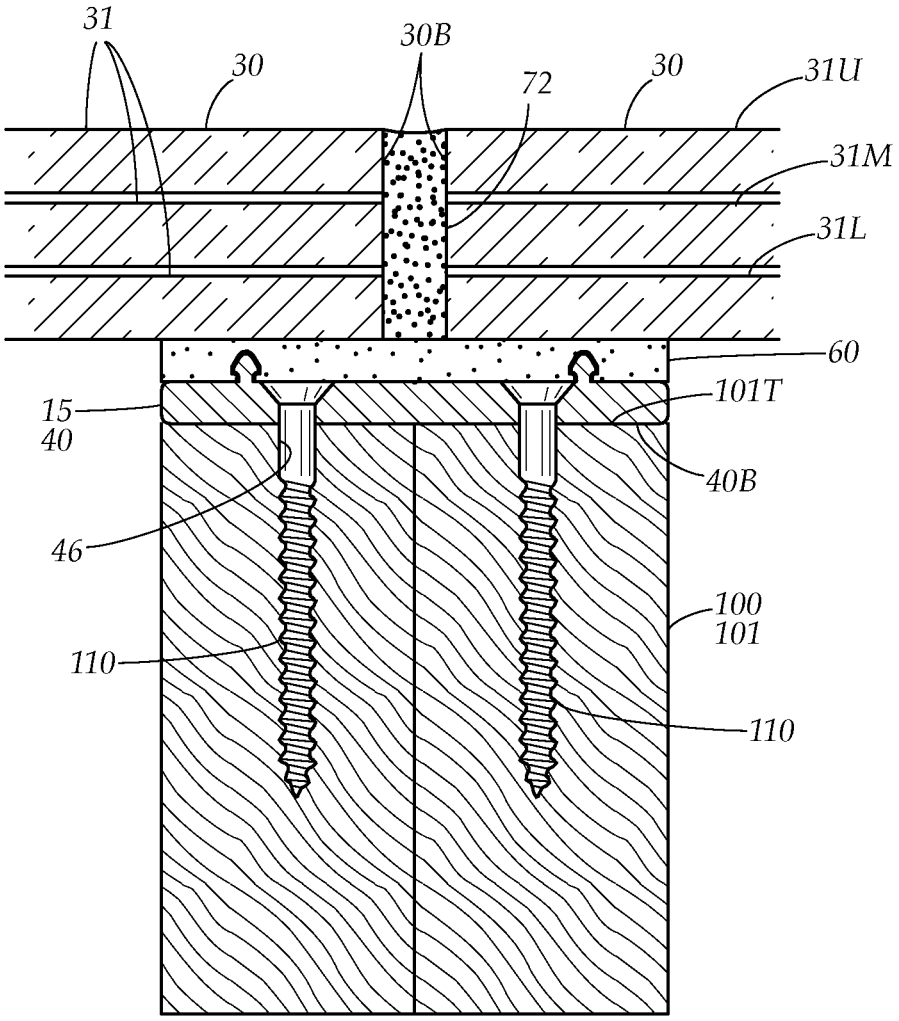
FIG. 4A is a side elevational view with parts broken away, illustrating the intermediate framing member fastened to wooden structural elements.
Figure 4B:
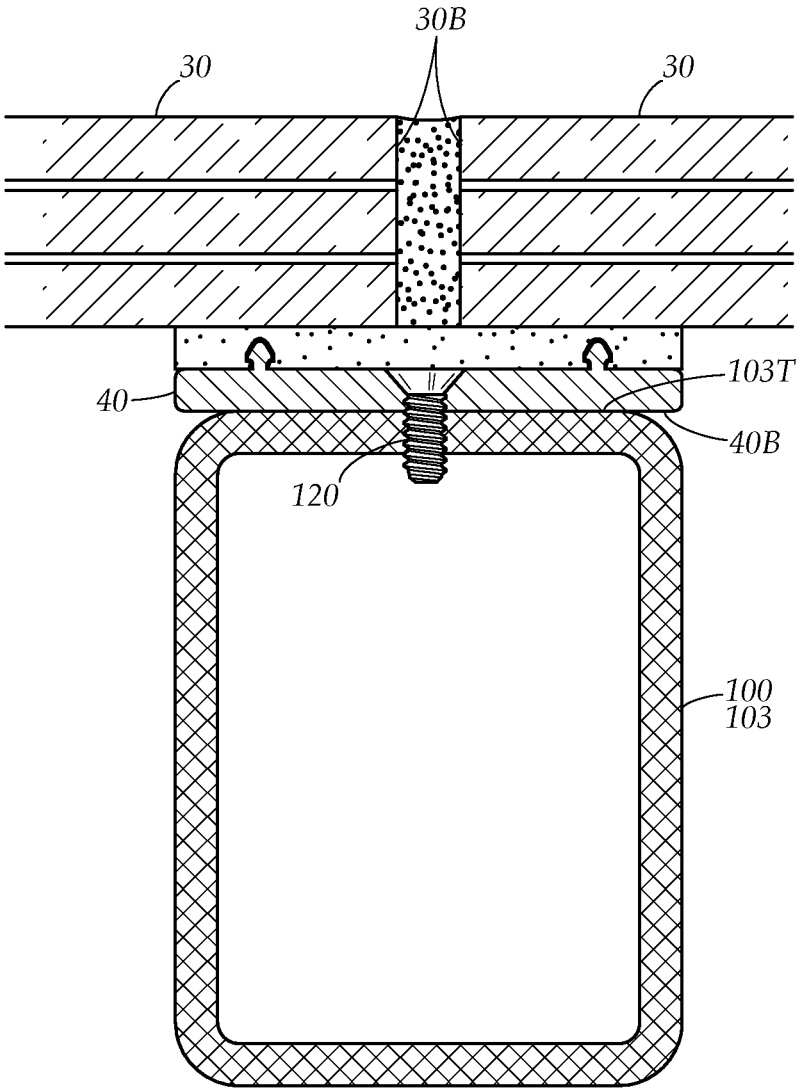
FIG. 4B is a side elevational view with parts broken away, illustrating the intermediate framing member fastened to an embodiment of a metal structural element.
Figure 5:
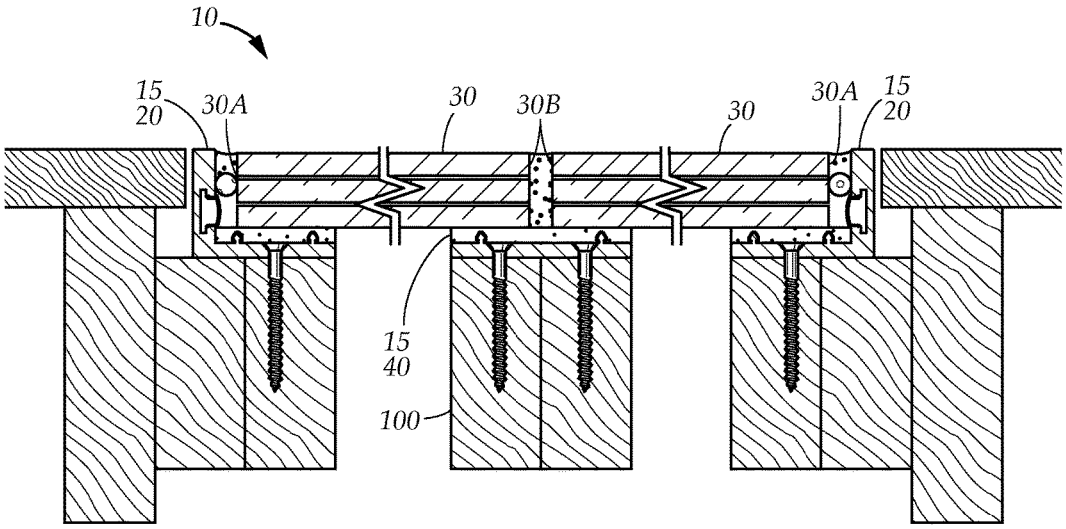
FIG. 5 is a side elevational view with parts broken away, illustrating the glass decking assembly employing both outer framing members and intermediate framing members.

FIG. 5 illustrates a building structure 100 with a glass decking assembly 10 attached to the building structure 100 with a framing assembly 15 that supports a pair of glass panels 30. Referring to FIG. 3A and FIG. 4A, the glass panels 30 each have at least one pane 31. When each panel 30 includes more than one pane 31, such panes thereby include an uppermost pane 31U and a lowermost pane 31L. When each panel 30 includes at least three panes 31, such panel 30 additionally includes a middle pane 31M. Each panel 30 has outer edges 30A that do not extend adjacent to other panels 30 as seen in FIG. 3A, and inner edges 30B that are located 'mid-span' and are thereby adjacent to other panels 30 as seen in FIG. 4B.

The framing assembly 15 includes an outer framing member 20 as seen in FIG. 3A, and an intermediate framing member 40 as seen in FIG. 4A. The outer framing members 20 and intermediate framing members 40 are each attached to a building structural element 100. The outer framing members 20 and intermediate framing members 40 each support the glass panels 30. In particular, the outer framing members 20 are employed to support the panel 30 near its outer edges 30A as seen in FIG. 3A, while the intermediate framing members 40 are employed to support adjacent panels 30 near their inner edges 30B as seen in FIG. 4A. Accordingly, referring to FIG. 5, the outer framing members 20 and intermediate framing members 40 are configured together to cooperatively support a pair of adjacent glass panels 30 of the glass decking assembly 10. In particular two outer framing members 20 are each supporting one of the glass panels 30 at one of its outer edges 30A, while the intermediate framing member 40 is supporting the glass panels 30 at one of their inner edges 30B. Note that the example illustrated is a simplified, two-dimensional depiction. Generally, however, the glass panels 30 would likely also be supported by additional framing members 40 (not shown) along its outer edges 30A that extend transversely between the outer framing members 40 that are actually shown in FIG. 5.

Figure 1A:
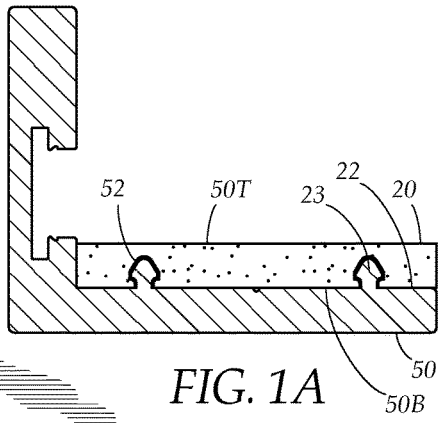
FIG. 1A is a side elevational view with parts broken away, illustrating an outer framing member in accordance with the present disclosure.
Figure 1B:
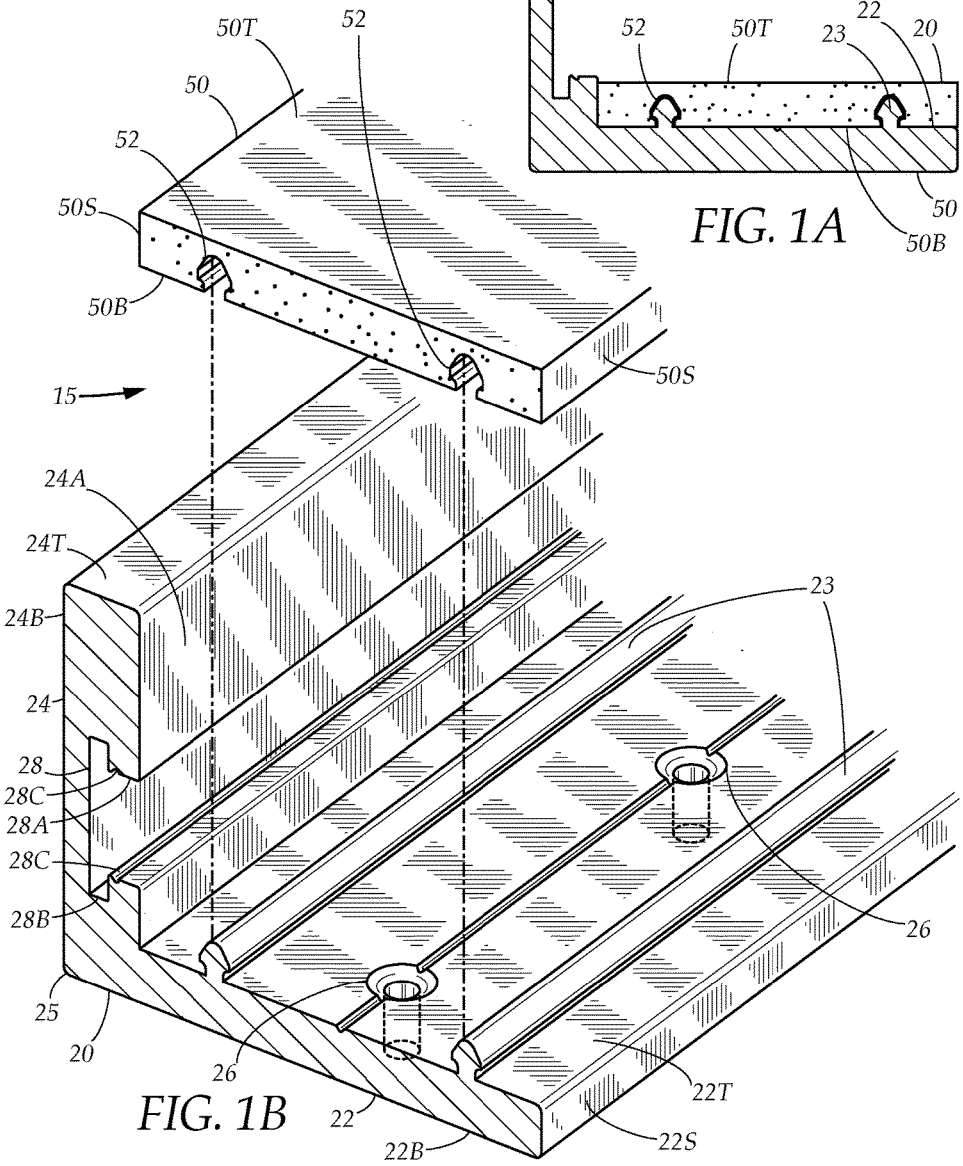
FIG. 1B is an exploded perspective view of the framing assembly, illustrating the interconnection of the outer framing member and an outer glass setting block.

Referring now to FIG. 1A and FIG. 1B, the outer framing member 20 is an extruded shape including a base portion 22 and a vertical portion 24 that meet perpendicularly at a corner 25. The base portion 22 has a top surface 22T, a bottom surface 22B, and a side edge 22S extending between the top surface 22T and bottom surface 22B fully opposite from the corner 25. The vertical portion 24 has an inside surface 24A, an outside surface 24B, and a top edge 24T extending between the inside surface 24A and the outside surface 24B fully opposite from the corner 25. The top surface 22T and bottom surface 22B of the base portion 22 extend substantially parallel to each other, and the inside surface 24A and outside surface 24B of the vertical portion 24 extend substantially parallel to each other.

The base portion 22 has a pair of longitudinal rails 23 that upwardly from the top surface 22T. The longitudinal rails 23 extend substantially parallel to each other and to the vertical portion 24. The base portion 22 also has a plurality of fastening holes 26 periodically spaced on the base portion 22. The fastening holes 26 extend fully through the base portion 22 from the top surface 22T to the bottom surface 22B, and are preferably countersunk at the top surface 22T. The vertical portion preferably includes a lighting channel 28 that extends inwardly from the inside surface 24A. The lighting channel 28 includes a channel opening 28A to the inside surface 24A of the vertical portion 24, and a flared interior portion 28B that is taller than the channel opening 28A. The channel opening 28A has a pair of grooves 28C for mating a lens 29 (see FIG. 3A) that spans the channel opening 28A and is translucent or transparent to propagate light from a lighting element, such as a rope light, extending longitudinally within the flared interior portion 28B, toward one of the panels 30 to "edge light" the glass thereof and provide a dramatic lighting effect.

Referring again to FIG. 1A and FIG. 1B, the framing assembly 15 includes an outer glass block 50 that is an extruded shape made from a gasket material with a pliable, deformable, rubbery texture. The glass block 50 has a top 50T, a bottom 50B, and sides 50S. The glass block has a pair of parallel rail slots 52 extending upwardly into the bottom 50B. The outer glass block 50 is sized to fit on the top surface 22T of the base portion 22 of the outer framing member 20, spanning fully between the inside surface 24A of the vertical portion 24 and the side edge 22S of the base portion 24. As the outer glass block 50 is being seated onto the top surface 22T of the base portion 22, the longitudinal rails 23 extend into the parallel rail slots 52, deforming the parallel rail slots 52 momentarily such that once the longitudinal rails 23 are fully inserted thereinto, the parallel rail slots 52 resiliently deflects to maintain the longitudinal rails 23 within the parallel rail slots 52 and thus to maintain the outer glass block 50 on the base portion 24.

Figure 2A:
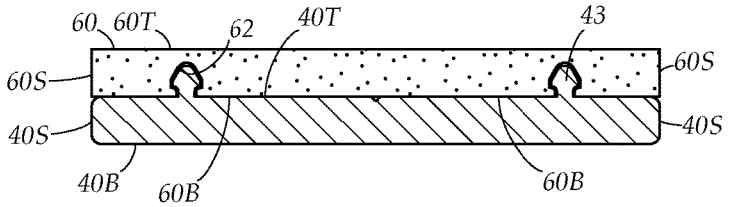
FIG. 2A is a side elevational view with parts broken away, illustrating an intermediate framing member in accordance with the present disclosure.
Figure 2B:
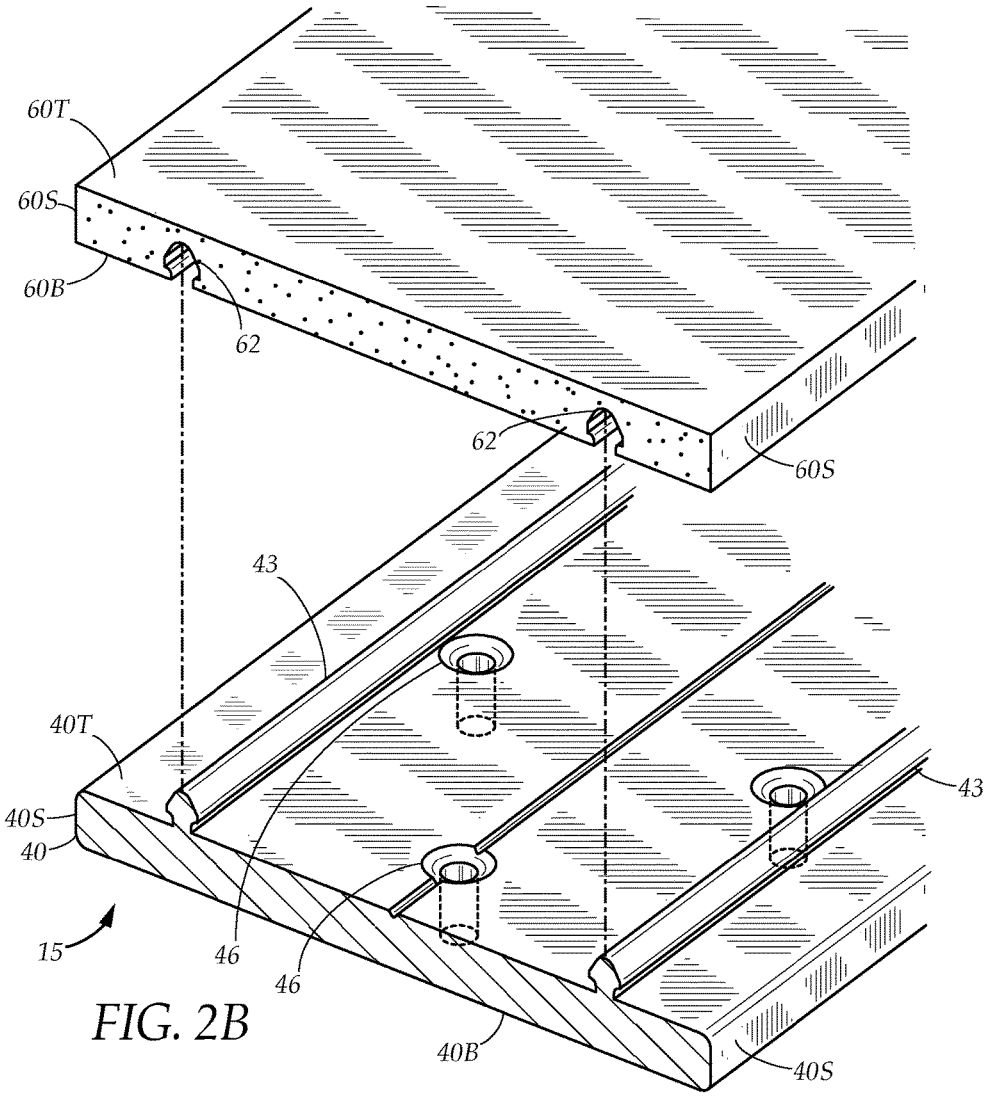
FIG. 2B is an exploded perspective view of the intermediate framing member, illustrating the interconnection of the intermediate framing member and the intermediate glass setting block.

Referring now to FIGS. 2A and 2B, the intermediate framing member 40 is an extruded shape including a top surface 40T, a bottom surface 40B, and side edges 40S extending between the top surface 40T and bottom surface 40B. The intermediate framing member 40 has a pair of longitudinal rails 43 that extend upwardly from the top surface 40T. The longitudinal rails 43 extend substantially parallel to each other and to the side edges 40S. The intermediate framing member 40 also has a plurality of fastening holes 46 periodically spaced on the intermediate framing member 40. The fastening holes 46 fully through the intermediate framing member 40 from the top surface 40T to the bottom surface 40B, and are preferably countersunk at the top surface 40T.

The framing assembly 15 also includes an intermediate glass block 60 that is an extruded shape made from a gasket material with a pliable, deformable, rubbery texture. The intermediate glass block 60 has a top 60T, a bottom 60B, and sides 60S. The intermediate glass block 60 has a pair of parallel rail slots 62 extending upwardly into the bottom 60B. The intermediate glass block 60 is sized to fit on the top surface 40T of the intermediate framing member 40, spanning fully between the side edges 40S. As the intermediate glass block 60 is being seated onto the top surface 40T, the longitudinal rails 43 extend into the parallel rail slots 62, deforming the parallel rail slots 62 momentarily such that once the longitudinal rails 43 are fully inserted thereinto, the parallel rail slots 62 resiliently deflects to maintain the longitudinal rails 43 within the parallel rail slots 62 and thus to maintain the intermediate glass block 60 on the intermediate framing member 40.

Figure 3B:
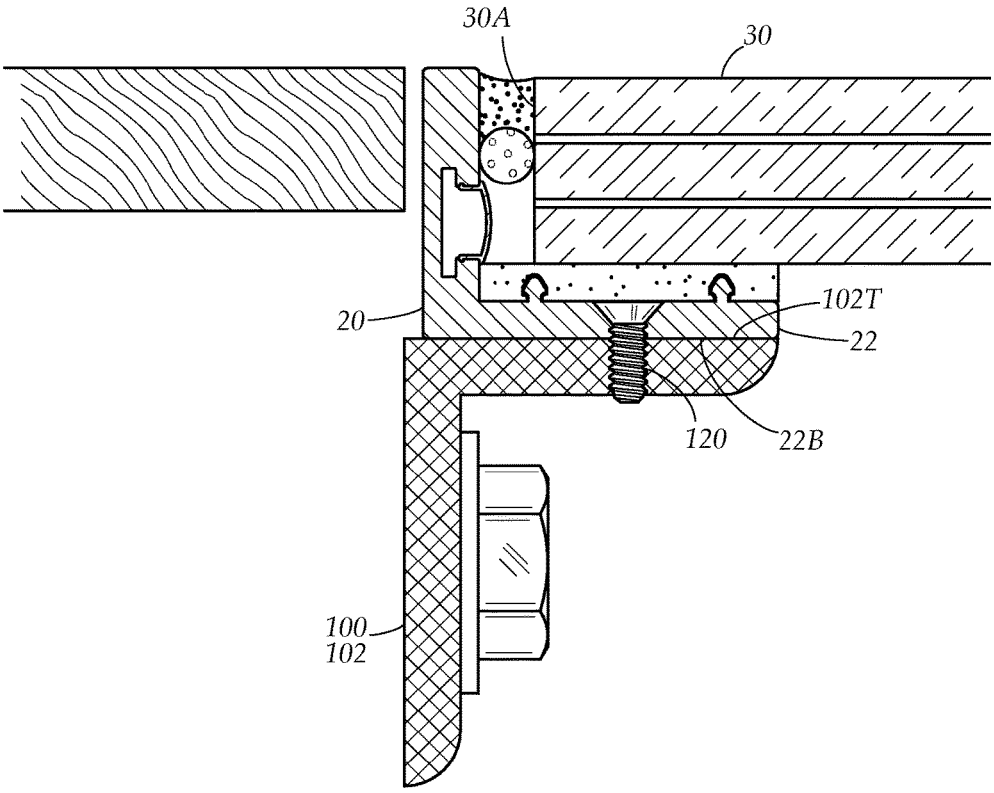
FIG. 3B is a side elevational view with parts broken away, illustrating the glass decking assembly where the outer framing member is fastened to an embodiment of a metal structural element.
Figure 3C:
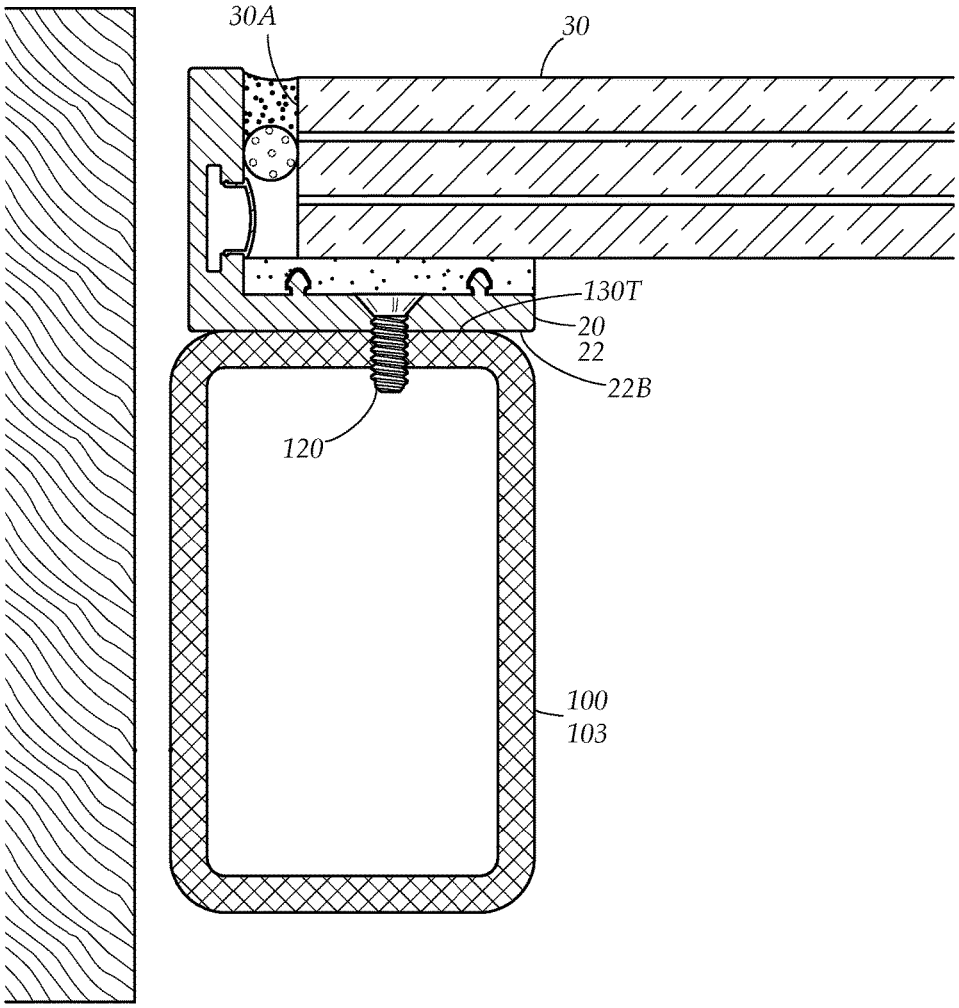
FIG. 3C is a side elevational view with parts broken away, illustrating the glass decking assembly where the outer framing member is fastened to another embodiment of a metal structural element.

FIG. 3A, FIG. 3B, and FIG. 3C, illustrate one of the glass panels 30 being supported by one of the outer framing members 20 near one of its outer edges 30A, with the outer framing member 20 secured to various embodiments of the building framing element 100. In particular, in FIG. 3A, the building framing element 100 includes at least one wood stud 101 that has a top surface 101T. The bottom surface 22B of the base portion 22 rests upon the top surface 101T of the wood stud 101, and a wood screw 110 extends through the base portion 22 to secure the outer framing member 20 to the wood stud 101. In FIG. 3B, however, the building framing element 100 is a metal structural element such as a right angle beam 102 having a top flange 102T. The bottom surface 22B of the base portion 22 rests upon the top flange 102T of the right angle beam 102, and a machine screw 120 extends through the base portion 22 to secure the outer framing member 20 to the right angle beam 102. FIG. 3C presents a further example, wherein the building framing element 100 is another embodiment of a metal structural element such as a box beam 103 having a top plate 103T. The bottom surface 22B of the base portion 22 rests upon the top plate 103T of the box beam 103, and a machine screw 120 extends through the base portion 22 to secure the outer framing member 20 to the box beam 103.

Figure 4C:
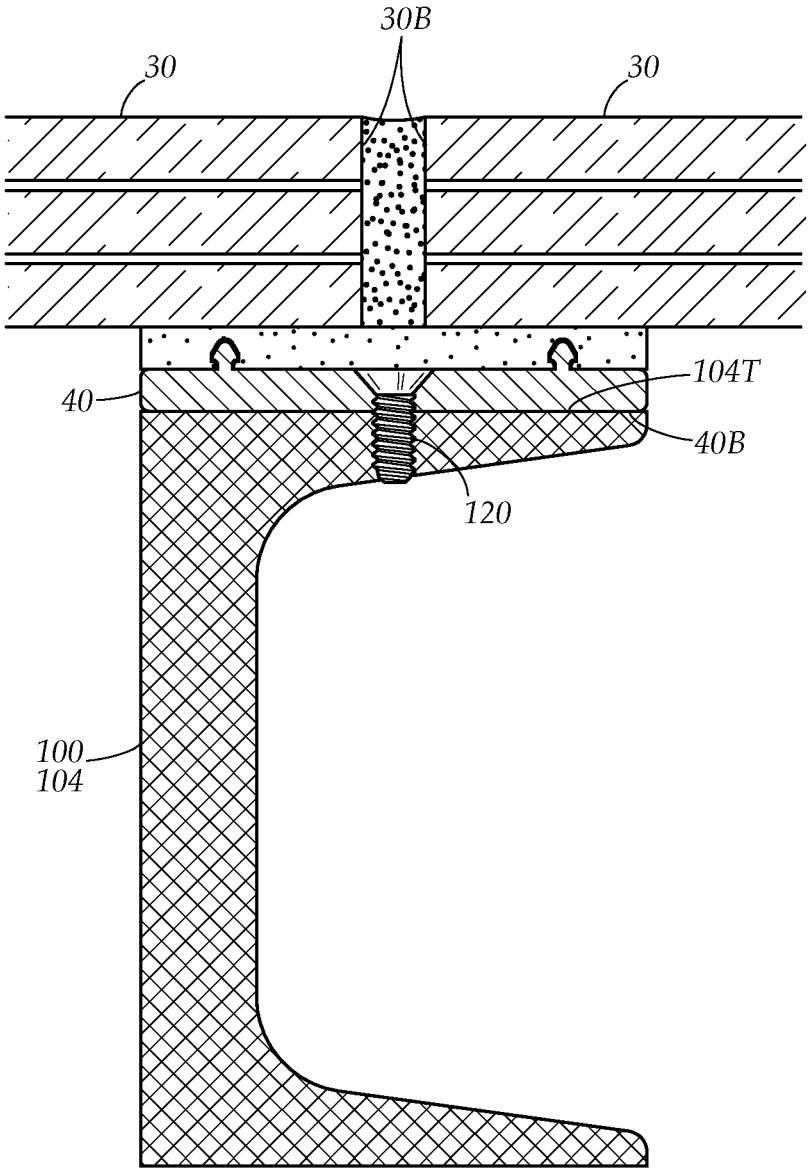
FIG. 4C is a side elevational view with parts broken away, illustrating the intermediate framing member fastened to an embodiment of another embodiment of a metal structural element.

FIG. 4A, FIG. 4B, and FIG. 4C, illustrate two adjacent glass panels 30 being supported by the intermediate framing member 40 near the inner edges 30B of the glass panels 30, with the intermediate framing member 40 secured to various embodiments of the building framing element 100. In particular, in FIG. 4A, the building framing element 100 shown is the wood stud 101. The bottom surface 40B of the intermediate framing member 40 rests upon the top surface 101T of the wood stud 101, and two wood screws 110 extend through the intermediate framing member 40 to secure it to the wood stud 101. FIG. 4B presents a further example, wherein the building framing element 100 shown is the box beam 103. The bottom surface 40B of the intermediate framing member 40 rests upon the top plate 103T of the box beam 103, and the metal screw 120 extends through the intermediate framing member 40 to secure it to the box beam 103. In FIG. 4C, however, the building framing element 100 shown is a u-shaped beam 104 having a top flange 104T. The bottom surface 40B of the intermediate framing member 40 rests upon the top flange 104T of the u-shaped beam 104, and the metal screw 120 extends through the intermediate framing member to secure it to the u-shaped beam 104.

Referring to FIG. 3A and FIG. 4A, installation of the glass decking assembly begins by configuring and installing the framing members 20, 40 to the building framing elements 100 by securing fasteners, such as the wood screw 101, through the fastening holes 26, 46. After the lighting channel 28 is configured as appropriate to the installation goals, the glass setting blocks 50, 60 are installed onto the framing members 20, 40 to cover the fasteners and to ready the framing members 20, 40 for seating the glass panels 30. Once the glass panels 30 are positioned upon the framing members 20, 40, a backer rod 70 is installed between the outer framing member 20 and the outer edges 30A of the glass panel 30, and a structural sealant 72, such as Dow Corning Structural Silicone, is used to fill the spaces above the backer rod 70 and between the inner edges 30B of the adjacent glass panels 30.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a glass anchoring system, for securing a pair of adjacent panels of structural glass. The disclosure is illustrated by example in the drawing figures, and throughout the written description. It should be understood that numerous variations are possible, while adhering to the inventive concept. Such variations are contemplated as being a part of the present disclosure.

What is claimed is:

1. A glass decking assembly, installed to a building structure having building structural members, for providing a horizontal and walkable glass decking surface, comprising:

a pair of outer framing members, each of the outer framing members having a base portion and a vertical portion, the base portion and vertical portion are perpendicular to each other and meet at a corner, the base portion has a top surface, a bottom surface, and a side surface that extends between the top surface and bottom surface opposite from the corner, the vertical portion has an outside surface, an inside surface, and a top surface that extends between the outside surface and inside surface opposite from the corner, each outer framing member has a plurality of fastening holes extending fully between the top surface and the bottom surface of the base portion and a pair of longitudinal rails extending parallel to each other and upwardly from the top surface of the base portion;

an intermediate framing member having a top surface, a bottom surface, a pair of side surfaces, a plurality of fastening holes extending fully between the top surface and the bottom surface of the intermediate framing member, and a pair of longitudinal rails extending parallel to each other and upwardly from the top surface of the intermediate framing member;

fasteners extending through the fastening holes in the outer framing members and intermediate framing member and securing said outer framing members and intermediate framing member to the building structural members;

a pair of outer glass blocks, each of said outer glass blocks made of a gasket material, having a top surface and a bottom surface, and having a pair of parallel rail slots extending upwardly into said bottom surface, each outer glass block is sized to fit on the top surface of the base portion of one of the outer framing members spanning fully between the inside surface of the vertical portion and the side edge of the base portion of said outer framing member, each outer glass block is attached to the top surface of the base portion of one of the outer framing members by mating the longitudinal rails of said outer framing member with the parallel rail slots of said outer glass block, covering the fasteners extending through the said outer framing member;

an intermediate glass block, made of a gasket material, having a top surface and a bottom surface, and having a pair of parallel rail slots extending upwardly into said bottom surface, the intermediate glass block is sized to fit on the top surface of the intermediate framing member spanning fully between the sides edges of said intermediate framing member, the intermediate glass block is attached to the top surface of the base portion of one of the outer framing members by mating the longitudinal rails of said outer framing member with the parallel rail slots of said outer glass block, covering the fasteners extending through the intermediate framing member; and a pair of adjacent structural glass panels, each of the pair of adjacent glass panels have an inner edge and an outer edge, the glass panels are each supported upon the outer glass block on one of the outer framing members near the outer edge of said glass panel and are supported by the intermediate glass block on the intermediate framing member near the inner edge of said glass panel, the inner edges of said adjacent structural glass panels are next to and parallel to each other.

2. The glass decking assembly as recited in claim 1, wherein each outer framing member has a lighting channel extending within the vertical portion with an opening extending through the inside edge of the vertical portion adapted for housing a lighting element, and a lens that is mated with the opening and is adapted for propogating light from the lighting channel and edge lighting one of the glass panels.

3. The glass decking assembly as recited in claim 2, wherein each structural glass panel has at least three panes of substantially the same size, including an uppermost pane, a lowermost pane, and a middle pane.

4. A glass decking assembly, for supporting a pair of adjacent glass panels upon a building structure having building structural members, each of said glass panels having an inside edge and an outside edge, comprising:

a pair of outer framing members, each of the outer framing members having a base portion and a vertical portion, the base portion and vertical portion are perpendicular to each other and meet at a corner, the base portion has a top surface, a bottom surface, and a side surface that extends between the top surface and bottom surface opposite from the corner, the vertical portion has an outside surface, an inside surface, and a top surface that extends between the outside surface and inside surface opposite from the corner, each outer framing member has a plurality of fastening holes extending fully between the top surface and the bottom surface of the base portion adapted to facilitate fastening said outer framing member to one of the building structural members, and a pair of longitudinal rails extending parallel to each other and upwardly from the top surface of the base portion;

an intermediate framing member having a top surface, a bottom surface, a pair of side surfaces, a plurality of fastening holes extending fully between the top surface and the bottom surface of the intermediate framing member adapted to facilitate fastening the intermediate framing member to one of the building structural members, and a pair of longitudinal rails extending parallel to each other and upwardly from the top surface of the intermediate framing member;

a pair of outer glass blocks, each of said outer glass blocks made of a gasket material, having a top surface and a bottom surface, and having a pair of parallel rail slots extending upwardly into said bottom surface, each outer glass block is sized to fit on the top surface of the base portion of one of the outer framing members spanning fully between the inside surface of the vertical portion and the side edge of the base portion of said outer framing member, each outer glass block is attached to the top surface of the base portion of one of the outer framing members by mating the longitudinal rails of said outer framing member with the parallel rail slots of said outer glass block, covering the fastenening holes extending through the said outer framing member, the outer glass blocks are each adapted for supporting one of the glass panels near its outer edge; and an intermediate glass block, made of a gasket material, having a top surface and a bottom surface, and having a pair of parallel rail slots extending upwardly into said bottom surface, the intermediate glass block is sized to fit on the top surface of the intermediate framing member spanning fully between the side edges of said intermediate framing member, the intermediate glass block is attached to the top surface of the base portion of one of the outer framing members by mating the longitudinal rails of said outer framing member with the parallel rail slots of said outer glass block, covering the fastenening holes extending through the intermediate framing member, the intermediate glass block is adapted for supporting the pair of adjacent glass panels with the inner edges of said pair of adjacent glass panels next to and parallel to each other.

5. The glass decking assembly as recited in claim 4, wherein each outer framing member has a lighting channel extending within the vertical portion with a channel opening extending through the inside edge of the vertical portion adapted for housing a lighting element, and a lens that is mated with the channel opening and is adapted for propogating light from the lighting channel and edge lighting one of the glass panels.

6. A glass decking assembly, for supporting a pair of adjacent glass panels upon a building structure having building structural members, each of said glass panels having an inside edge and an outside edge, comprising:

a pair of outer framing members, each of the outer framing members having a base portion and a vertical portion, the base portion and vertical portion are perpendicular to each other and meet at a corner, the base portion has a top surface, a bottom surface, and a side surface that extends between the top surface and bottom surface opposite from the corner, the vertical portion has an outside surface, an inside surface, and a top surface that extends between the outside surface and inside surface opposite from the corner, each outer framing member has a plurality of fastening holes extending fully between the top surface and the bottom surface of the base portion adapted to facilitate fastening said outer framing member to one of the building structural members, each outer framing member also has a lighting channel in the vertical portion having a channel opening to the inside surface and a flared interior portion that is taller than the channel opening;

an intermediate framing member having a top surface, a bottom surface, a pair of side surfaces, a plurality of fastening holes extending fully between the top surface and the bottom surface of the intermediate framing member adapted to facilitate fastening the intermediate framing member to one of the building structural members;

a pair of outer glass blocks, each of said outer glass blocks made of a gasket material, having a top surface and a bottom surface, and having a pair of parallel rail slots extending upwardly into said bottom surface, each outer glass block is sized to fit on the top surface of the base portion of one of the outer framing members spanning fully between the inside surface of the vertical portion and the side edge of the base portion of said outer framing member, each outer glass block is selectively attached to the top surface of the base portion of one of the outer framing members after fastening said outer framing member to one of the building structural elements, covering the fastenening holes extending through the said outer framing member, the outer glass blocks are each adapted for supporting one of the glass panels near its outer edge; and an intermediate glass block, made of a gasket material, having a top surface and a bottom surface, and having a pair of parallel rail slots extending upwardly into said bottom surface, the intermediate glass block is sized to fit on the top surface of the intermediate framing member spanning fully between the sides edges of said intermediate framing member, the intermediate glass block is selectively attached to the top surface of the base portion of one of the outer framing members after fastening said outer framing member to one of the building structural elements, covering the fastenening holes extending through the intermediate framing member, the intermediate glass block is adapted for supporting the pair of adjacent glass panels with the inner edges of said pair of adjacent glass panels next to and parallel to each other.

7. The glass decking assembly as recited in claim 6, wherein each of the outer framing members has a pair of longitudinal rails extending parallel to each other and upwardly from the top surface of the base portion of said outer framing member; wherein the intermediate framing member has a pair of longitudinal rails extending parallel to each other and upwardly from the top surface of the intermediate framing member; wherein each outer glass block is attached to the top surface of the base portion of one of the outer framing members by mating the longitudinal rails of said outer framing member with the parallel rail slots of said outer glass block; and wherein the intermediate glass block is attached to the top surface of the base portion of one of the outer framing members by mating the longitudinal rails of said outer framing member with the parallel rail slots of said outer glass block.

8. The glass decking assembly as recited in claim 7, wherein the lighting channel of each outer framing member has a pair of grooves within the channel opening, and wherein each outer framing member has a lens for mating with the grooves and spanning the channel opening.

* * * * *